US006181885B1

(12) United States Patent
Best et al.

(10) Patent No.: US 6,181,885 B1
(45) Date of Patent: Jan. 30, 2001

(54) PRINTING OR COPYING APPLIANCE WITH EXCHANGEABLE PART UNITS WHICH HAVE AN IDENTIFICATION DEVICE, METHOD FOR OPERATING AN APPLIANCE OF THIS TYPE AND TONER CONTAINERS FOR USE IN THE SAME

(75) Inventors: Arno Best, Lohhof; Volker Rademacher, Markt Schwaben; Christian Schmidt-Hoenow, Germering; Kurt Zietlow, Grafing; Volker Warbus, Oberhaching; Heinrich Lay, Töging; Karola Scheidig, Plienig, all of (DE)

(73) Assignee: Océ Printing Systems GmbH, Poing (DE)

( * ) Notice: Under 35 U.S.C. 154(b), the term of this patent shall be extended for 0 days.

(21) Appl. No.: 09/381,605

(22) PCT Filed: Feb. 6, 1998

(86) PCT No.: PCT/DE98/00355

§ 371 Date: Jan. 3, 2000

§ 102(e) Date: Jan. 3, 2000

(87) PCT Pub. No.: WO98/43136

PCT Pub. Date: Oct. 1, 1998

(30) Foreign Application Priority Data

Mar. 26, 1997 (DE) ..... 197 12 798

(51) Int. Cl.[7] ..... G03G 15/00
(52) U.S. Cl. ..... 399/12; 399/13; 399/119
(58) Field of Search ..... 399/12, 13, 24–28, 399/111–125

(56) References Cited

U.S. PATENT DOCUMENTS 4,523,299 6/1985 Donohue et al. .
4,747,071 5/1988 Sato .
4,851,875 7/1989 Tanimoto .

(List continued on next page.)

FOREIGN PATENT DOCUMENTS 40 21 242 8/1991 (DE) .
195 40 138 12/1996 (DE) .
0 104 887 4/1984 (EP) .
0 395 320 10/1990 (EP) .
0 532 308 3/1993 (EP) .
0 743 567 11/1996 (EP) .
0 784 249 7/1997 (EP) .
WO 96/02871 8/1995 (WO) .
WO 96/02872 12/1995 (WO) .

OTHER PUBLICATIONS

European Patent Office—Patent Abstracts of Japan—62075667—Jul. 4, 1987.
Patent Abstracts of Japan—1278—Nov. 21, 1999 vol. 15/No. 460.
Patent Abstracts of Japan—P–1404 Aug. 18, 1992 vol. 16/No. 386.
Patent Abstracts of Japan—P–1501 Mar. 15, 1993, vol. 17/No. 122.
Patent Abstracts of Japan—P–1373 Jun. 18, 1992, vol. 16/No. 272.
Bussysteme—1993 CAN vernetzt Sensoren Design & Elektronik Sensortechnik.
European Patent Office—Patent Abstracts of Japan—06035258—Oct. 2, 1994.

*Primary Examiner*—Richard Moses
(74) *Attorney, Agent, or Firm*—Schiff Hardin & Waite

(57) ABSTRACT

In a printing or copying device which has one or several exchangeable part units with a modular assembly, the part unit to be identified has an identification device with a non-volatile memory for storing function-relevant operating data of the part unit, said operating data being allocated to operating states. The part unit also has a communication interface for detachably connecting the identification device to a process control device of the printing or copying device.

42 Claims, 6 Drawing Sheets

U.S. PATENT DOCUMENTS

| | | | | |
|---|---|---|---|---|
| 4,961,088 | * | 10/1990 | Gilliland et al. | 355/206 |
| 5,132,729 | * | 7/1992 | Matsushita et al. | 355/203 |
| 5,146,270 | * | 9/1992 | Matsuo et al. | 355/200 |
| 5,491,540 | | 2/1996 | Hirst . | |
| 5,579,088 | * | 11/1996 | Ko | 355/203 |
| 5,708,912 | * | 1/1998 | Lee | 399/24 |
| 5,778,297 | | 7/1998 | Reichl et al. . | |
| 5,835,817 | * | 11/1998 | Bullock et al. | 399/25 |
| 5,862,429 | * | 1/1999 | Ueno et al. | 399/13 |
| 5,878,298 | * | 3/1999 | Nakano | 399/24 |
| 5,937,239 | * | 8/1999 | Watanabe et al. | 399/111 |
| 6,019,461 | * | 2/2000 | Yoshimura et al. | 347/86 |

* cited by examiner

PRINTING OR COPYING APPLIANCE WITH EXCHANGEABLE PART UNITS WHICH HAVE AN IDENTIFICATION DEVICE, METHOD FOR OPERATING AN APPLIANCE OF THIS TYPE AND TONER CONTAINERS FOR USE IN THE SAME

BACKGROUND OF THE INVENTION

The invention is directed to a printer or copier device having modularly constructed, interchangeable sub-units and an identification arrangement allocated to the sub-units for storing function-relevant operating data allocated to operating conditions, and is also directed to a method for the operation of such a device.

PCT/DE95/00635 discloses an electrophotographic printer means for both-sided printing of a web-shaped, narrow recording medium and for single-sided printing of one broad recording medium or a plurality of parallel, narrow recording media. Given the known printer unit, the various units are designed as interchangeable modules. It is thus possible, for example, to adapt the printer unit to the greatest variety of operating conditions by merely replacing the electrophotographic printer module.

A multi-color simplex or duplex mode is possible with the printer unit by inserting a developer station with a plurality of developer chambers arranged side-by-side that is disclosed by DE-C1-195 40 138.

When the printer unit is employed only in single-color mode, a developer station is utilized as disclosed by PCT/DE95/00635.

Both publications are incorporated into the disclosure of this application.

High-performance printers of that type are frequently employed for printing out data in computer centers. These data can, for example, be invoices, control decisions or other individualized printouts, for example individualized advertising. When a plurality of these devices are utilized in shifts in the computer center, then the majority of print jobs are print jobs in single-color simplex or duplex mode. A smaller part of the print jobs require multi-color printing mode. With modularly constructed printers, it is therefore possible to keep one or more developer stations suitable for the multi-color printing mode ready as disclosed, for example, by DE-C1-4126465, and to insert this as needed into the corresponding printer given the presence of a multi-color printing job and to interchange it with the single-color developer station. A uniform, performance-adapted usage of the printer thus derives.

The various, modularly constructed units of the printer unit, however, are subject to wear. They require maintenance dependent on the duration of utilization. This is particularly true of the developer stations with the single-color or multi-color toner contained therein. Dependent on the quantity printed, the toner mix composed of carrier and toner particles changes and fresh toner must be supplied.

When, thus, the greatest variety of developer stations or, respectively, the greatest variety of unit modules are to be employed in the greatest variety of printer units, it is necessary that the operator be given information about the operating conditions of the interchanged module after the replacement. These operating conditions can, for example, be the toner filling condition in the case of developer stations and, thus, the information about the quantity of printing still available or, respectively, the information about the quantity of printing already printed with the developer station and, thus, the history of the developer station. Given fixing stations, it is of interest to obtain information about the wear condition and, thus, the operating duration of the fixing station, etc.

SUMMARY OF THE INVENTION

It is therefore an object of the invention to provide a printer or copier device having one or more modularly constructed, interchangeable sub-units such that, given simultaneous operation of a plurality of printers, an operator is in the position to replace the modules performance-adapted and to monitor their operating conditions.

In a printer or copier device of the tye initially cited, this object is achieved.

According to the invention whereby a printer or copier device has one or more modularly constructed, interchangeable sub-units. At least one of the sub-units which is to be identified has an identification unit having a non-volatile memory for storing operating data of the sub-unit allocated to function-relevant operating conditions. A communication interface is provided for coupling the identification unit to a process control unit of the device, the communication interface effecting an at least partially wireless data transmission between the sub-unit and the process control unit.

According to another aspect of the invention, a method and apparatus is provided for operation of a printer or copier device wherein a toner container is provided. An identification unit is provided having a non-volatile memory for storing operating data as well as a communication interface for coupling of the identification unit to a process control unit of the printer or copier device. The toner container is inserted into the printer or copier device and then a read station is checked to determine whether an electronic data memory is present on the toner container. When a data memory is present, stored data are read from the data store by the read station and are supplied to the process control unit.

In another aspect of the invention, a toner container is provided for employment in a printer or copier device having a process control unit. An identification unit is provided with a non-volatile memory for storing operating data as well as a communication interface for transmission of at least one of data and energy between the identification unit and the process control unit.

The goal is also achieved with the invention of providing the modules such that information about the operating condition of the modules can be called at any time.

Advantageous embodiments of the invention are described in the subclaims.

According to the invention, each of the sub-units is provided with an identification arrangement that contains electronic components such as a flat module and that is in the position of autonomously undertaking both identification as well as storing in a non-volatile memory. An automatic balancing of the function parameters of the overall system set in a higher-ranking unit is thus possible, incorrect operations being thereby prevented.

All function-relevant operating conditions of the sub-unit are thereby stored.

This enables an exact tracking of operating conditions and malfunctions for each sub-unit individually and unambiguously. This is a considerable advantage in case of service or in the analysis of returns.

When the sub-unit is a matter of a developer station, then the mechanism of this developer station is implemented such that the technically adept lay person can implement the interchange of this sub-unit himself and without monitoring by specifically trained personnel. According to the invention, a flat module equipped with a micro-controller is integrated in this developer station, this flat module being in communication via a communication interface, for example a CAN (Controller Area Network) bus, with the higher-ranking process controller (device controller) that controls this sub-unit.

Dependent on the operating conditions acquired by this higher-ranking controller, the assembly integrated on the sub-unit, for example the assembly integrated on the developer station, deposits the operating data in a suitable, non-volatile memory, for example, an EEPROM. As a result thereof, the data allocated to the operating conditions are not lost when the developer station is removed from the printer and thus loses power. When the developer station is re-introduced into a printer, whereby it is of no significance whether it is the same printer or a structurally identical, different printer, the corresponding settings are read out upon demand by the higher-ranking process controller, being read out from the non-volatile memory and being made available via the communication interface and, for example, being displayed on an operating display. The input of, for example, the serial number in the toner type, etc., is only required upon initial installation of a developer station equipped in this way.

In a further exemplary embodiment of the invention, a sub-unit contains a non-volatile memory in which both identification data as well as operating data of the sub-unit are stored. After the installation of the unit, the identification data are identified and interpreted by an identification or read arrangement. When the memory is missing or when the identification data are illegible, then a message is generated on a display means, and the operator is requested to input the data. Subsequently, standard values matching the identification data are offered for the operating parameters and the printing mode is begun.

The memory is usually not present particularly given older models of sub-units. The invention makes it possible to employ both these older as well as the more recent sub-units provided with memories in printer or copier devices without having to forego the advantages of the most recent developments.

In a further, preferred exemplary embodiment of the invention the data transmission between electronic memory and identification arrangement occurs in wireless fashion. As a result thereof, it is possible to provide an identification arrangement fixed to the device and to accomplish the data transfer between it and the memory reliably and without time delay after the insertion of the sub-unit.

In particular, performance-adapted operation of a plurality of printers in parallel operation is possible due to the invention. A uniform usage of all printers in a printer park thus derives with high operating dependability, since the operating conditions of all unit modules are constantly monitored.

A smaller component part that is provided for integration in a larger sub-unit, for example a toner bottle that is installed into a developer station, can also be understood as sub-unit in the sense of the invention.

Particularly given toner bottles, it is proven advantageous to equip these with a wireless communication location. Such interfaces can be obtained, for example, as chip cards that contain a data store (EEPROM), an electronic circuit for memory management and data transmission as well as an antenna that serves both for data transmission as well as for the energy supply of the chip card. Compared to a data transfer via electrical contacts, a wireless data transmission has the advantages that it is not subject to any wear and cannot be negatively influenced by contamination. Particularly given toner bottles, the dependability of the data transmission remains the same despite dust at the communication interfaces of the toner bottle and/or at the device.

Embodiments of the invention are shown in the drawings and are described in greater detail below by way of example.

and

Figure 6:
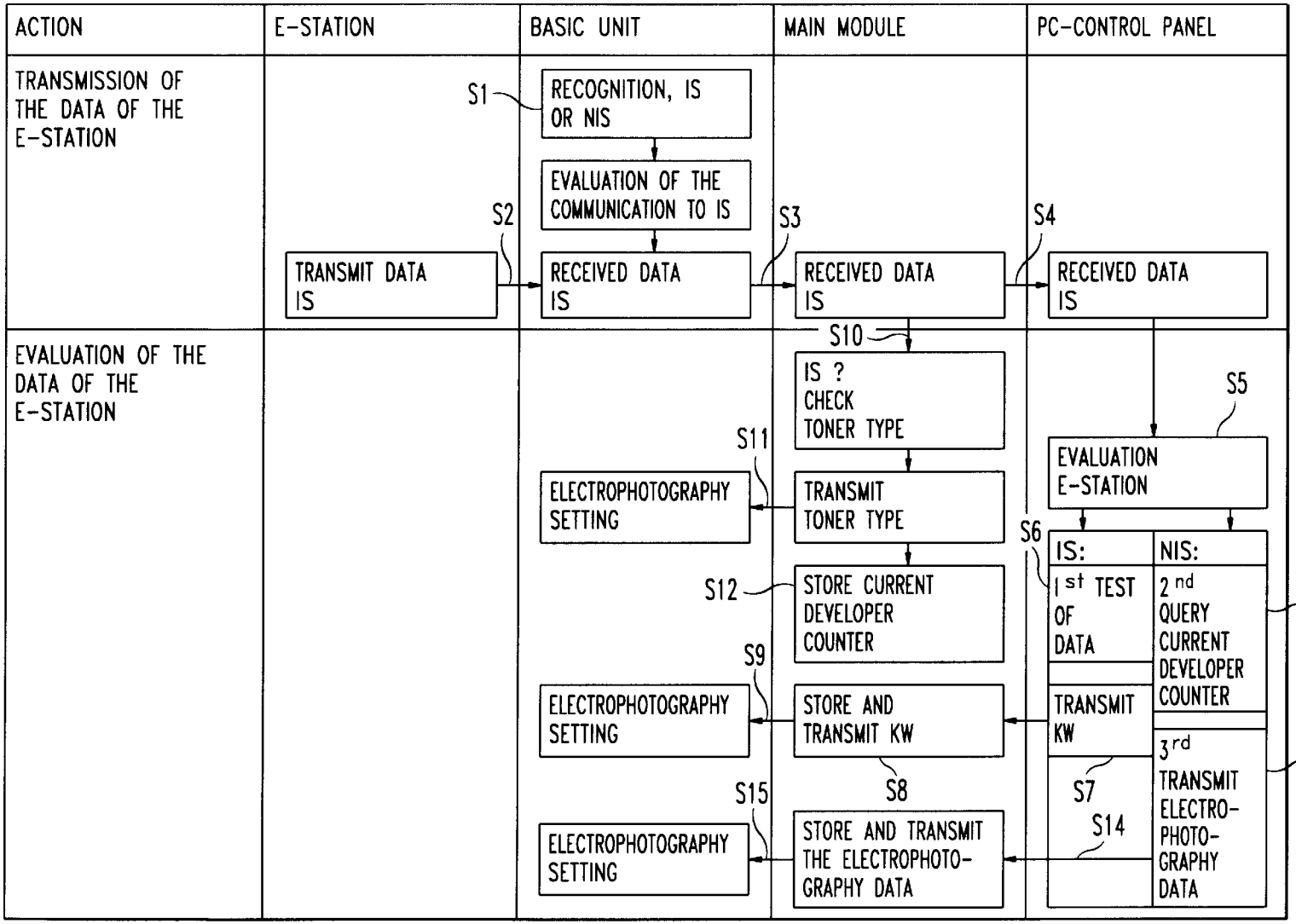

FIG. 6 is low chart.

DESCRIPTION OF THE PREFERRED EMBODIMENTS

Figure 1:
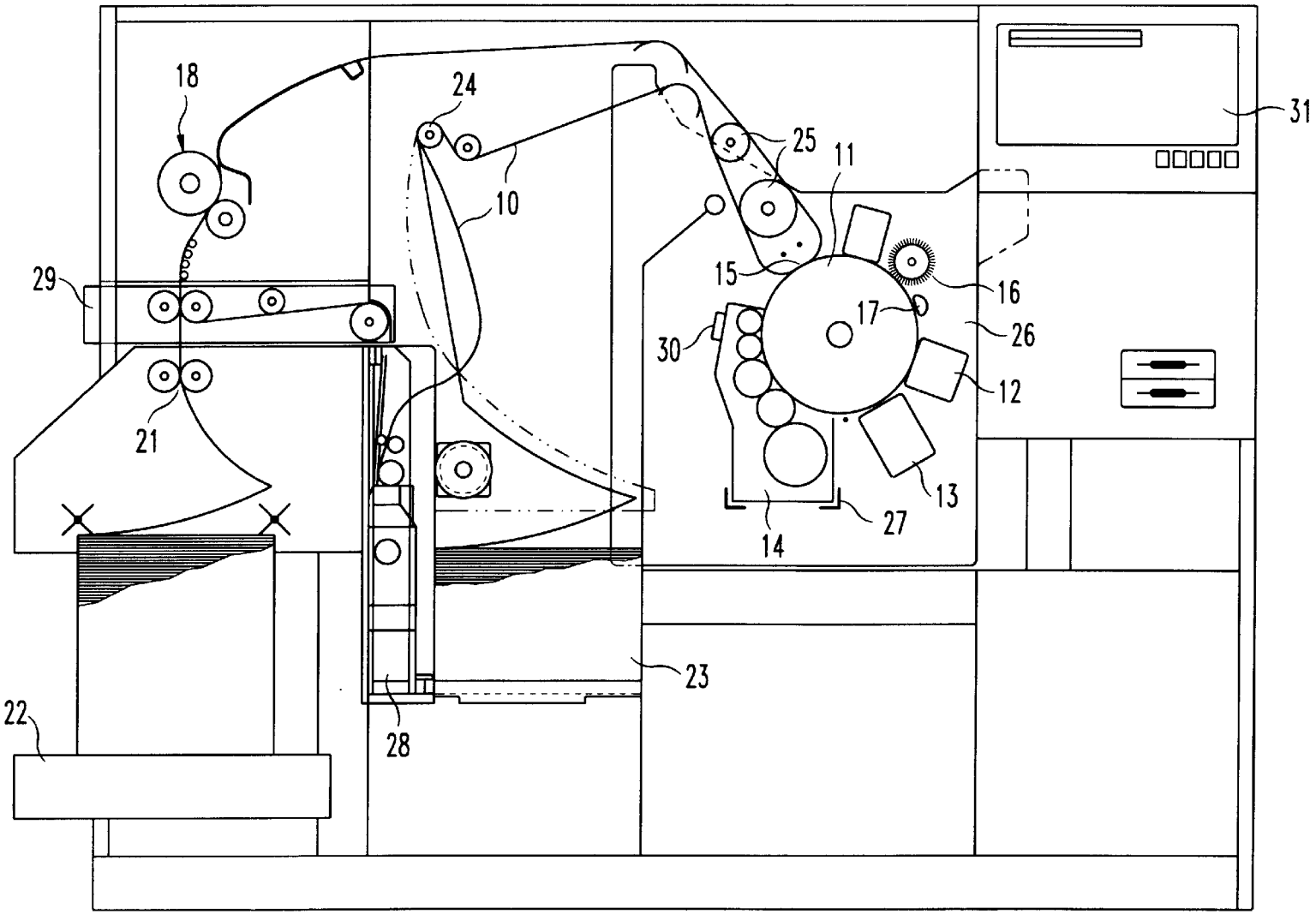
FIG. 1 is a schematic illustration of an electrophotographic printer means comprising interchangeable sub-units in the form of modules.

An electrophotographic printer unit single-color or multicolor, single-sided or both-sided printing of web-shaped recording media 10 having different web width fundamentally known from PCT/DE95/00635 and schematically shown in FIG. 1 contains an electromotively driven photoconductor drum 11 as intermediate carrier. The various units for the electrophotographic process are grouped around the intermediate carrier 11. These are essentially a charging unit 12 in the form of a charging Corotron for charging the intermediate carrier 11; a character generator having a light-emitting diode comb for character-dependent illumination of the intermediate carrier 11 that extends over the entire useable width of the intermediate carrier 11; a developer station 14 for inking the character-dependent charge image on the intermediate carrier 11 with the assistance of a single-component or two-component developer mix; a transfer printing station 15 that extends over the width of the intermediate carrier 11 and with which the toner images are transferred onto the recording medium 10. For removing the residual toner after the development and the transfer printing, a cleaning station 16 is provided with cleaning brush and corresponding extraction unit integrated therein as well as a discharge unit 17. The intermediate carrier 11 is electromotively driven and moves in arrow direction during printing operations.

The printer unit also contains a fixing station 18 following the transfer printing station 15 in the conveying direction of the recording medium, said fixing station 18 being designed as thermal print fixing station, and also contains a delivery unit 21 following the fixing station with guide rollers for delivering the recording medium 10 to an internal stacking unit 22 or to an external stacking unit or other post-processing unit arranged outside the printer unit.

The web-shaped recording medium 10 is fabricated, for example, as pre-folded continuous form paper provided with margin perforations and is supplied to the transfer printing station 15 via delivery rollers 24 of a pivotable paper separating unit proceeding from an internal supply region 23. However, it is also possible to supply a recording medium without margin perforations via a roller delivery.

The transport of the recording medium 10 thereby preferably occurs via a conveyor unit 25 allocated to the transfer printing station 15 in the form of conveyor belts provided with pins that engage via drive shafts into the margin perforations of the recording medium 10. Further, a turn-over unit 28 via which the recording medium already printed on the front side is turned over for printing the backside and is resupplied to the transfer printing station 15 is arranged in the housing region of the printer device, namely in a receptacle region for the internal supply stack 23. The turn-over unit 28 is in communication with the fixing station 18 via a return channel 29.

Fundamentally, the units in the illustrated printer device are combined to form interchangeable modules or are designed as interchangeable modules. This is true both of the turn-over means 28, the return channel 29 as well as of the electrophotographic printer module 26 with the units for the electrophotographic processor arranged therein. The developer station 14 is separately interchangeable in the electrophotographic printer module 26. To this purpose, it is seated on rails 27 and can thus be pushed out of the printer unit perpendicular to the plane of the drawing and replaced. Its fundamental structure is disclosed by DE-C1-19540138. An identification unit 30 in the form of a flat module whose function shall be explained later is arranged on the developer station 14.

Figure 3:
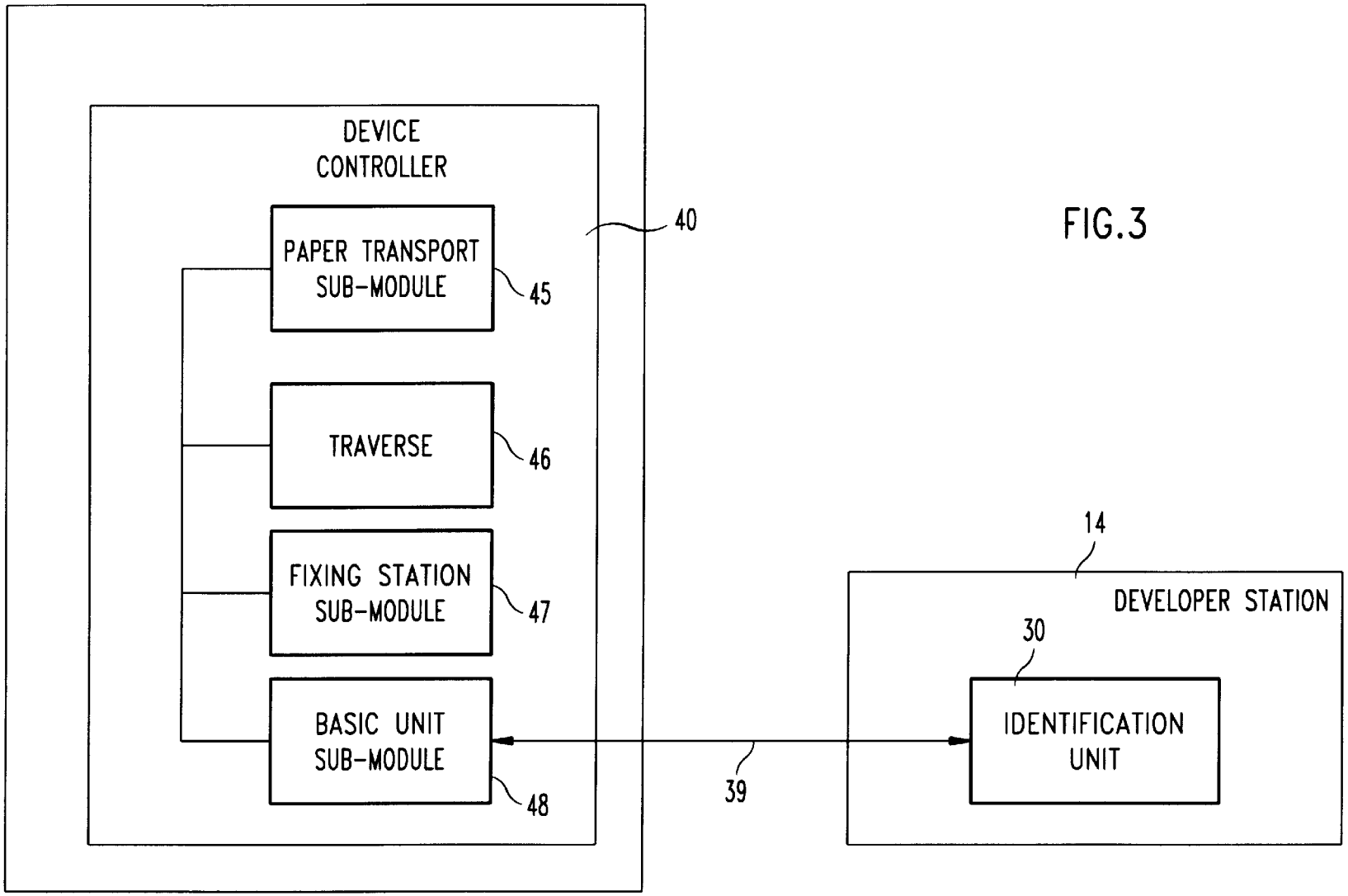
FIG. 3 is a schematic block circuit diagram of the coupling of the apparatus controller of the device with the identification arrangement.

The printer unit is controlled via a printer controller schematically shown in FIG. 3 whose fundamental structure is disclosed by PCT/DE95/00635. The operation of the printer unit occurs via a control panel display 31 in the form of a touch screen picture screen.

Figure 2:
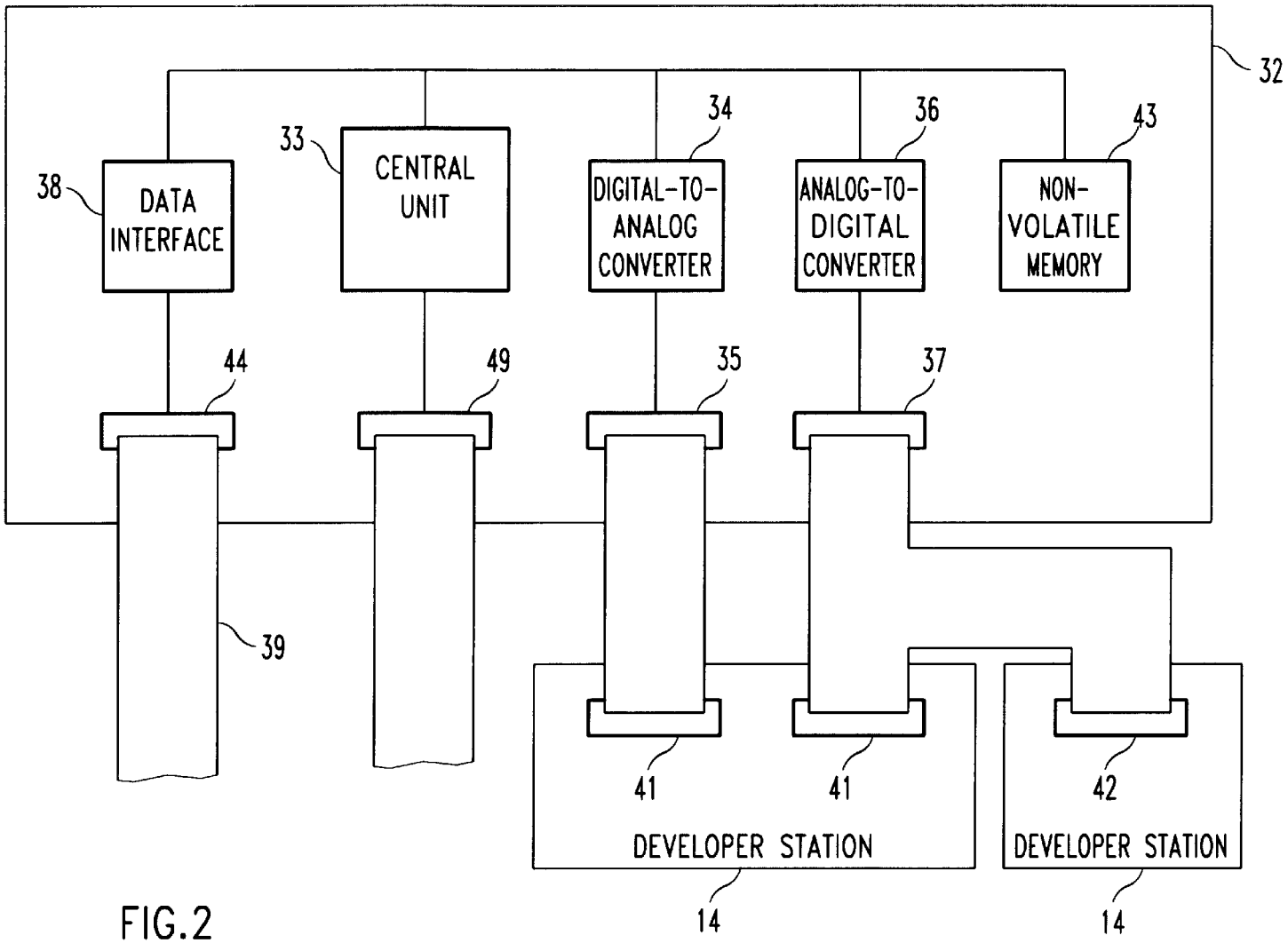
FIG. 2 is a schematic block circuit diagram of an identification arrangement coupled to an interchangeable developer station.

The identification unit 30 of FIG. 1 secured on the developer station 14 has a structure as shown in FIG. 2. The identification arrangement is composed of a plurality of electronic modules arranged on a printed circuit board 32 that are connected to one another via control lines to a microprocessor control. An 8-bit processor with an on-chip EPROM is provided as a central unit with a corresponding main memory 33. It is in communication with a digital-to-analog converter 34 with terminal 35 and with an analog-to-digital converter 36 with a corresponding terminal 37. A nonvolatile memory 43 in the form of an EEPROM is also coupled to the central unit via a line. A data interface 38 sees to the connection to a communication interface that is designed as a CAN bus 39. This CAN bus couples the identification unit 30 to the higher-ranking process controller of the device, namely the device controller 40.

A plurality of toner concentration sensors 41 that were inductively and analog as well as one or more temperature sensors 42 are arranged in the developer station 14. The toner concentration sensors 41 inductively identify that ratio of the carrier particles composed of iron to the toner particles of the developer mix, namely taking ambient temperature and page counter reading into consideration and, potentially, taking other influencing quantities into consideration. The need for fresh toner is thus identified and communicated to the device controller. This actuates the corresponding fresh toner delivery unit in the device. In order to be able to take the influencing quantities such as ambient temperature, page counter reading and, for example, page size into consideration, the operating point of the toner concentration sensors 41 is readjusted via the digital-to-analog converter 34 with its terminal 35, whereby the digital-to-analog converter converts the digital signals of the central unit 33 into corresponding analog signals for the toner concentration sensor 41.

The data about page counter reading and, potentially, page size are communicated to the central unit 33 via the device controller 40 and the CAN bus 39.

The analog measured result of the toner concentration sensors 41 and of the temperature sensors 42 is supplied via the terminal 37 to the analog-to-digital converter 36 that converts the analog data into digital data for the central unit 33.

The calculated measured result and, thus, the percentage relationship between carrier and toner particles is digitally deposited in the non-volatile memory 43 (EEPROM). The same is true of the data about the page counter reading or, respectively, page size supplied from the device controller 40. The deposit of the data thereby occurs, for example, in the form of a data log listing the entire history. These data are thus always allocated to the developer station 14 firmly connected to the identification unit 30 and can be directly fetched from the non-volatile memory 43 after replacement of the developer station 14. In order to enable this replacement, the CAN bus 39 is connected via a plug 44 to the data interface 38. Upon replacement of the developer station 14, the plug is released, the developer station is removed, and the new developer station is inserted and the plug connection 44 is again closed.

According to the illustration of FIG. 3, the device controller 40 contains a plurality of microprocessor-controlled sub-systems in the form of sub-modules. The sub-module 45 is thus responsible for the control of the paper transport; the sub-module 46 is responsible for the slip regulation of the recording medium or, respectively, the paper transport, as disclosed by PCT/DE95/00635. The sub-module 47 of the device controller controls the fixing station and the sub-module 48 controls the basic unit. The sub-module basic unit 48 controls the under-pressure, the toner concentration and supplies the central clock of the system. This sub-module 48 is coupled via the serial interface (CAN bus 39) to the identification unit 30. The display unit 31 is also connected to the sub-module 48. The aging condition of the toner identified via the toner concentration sensors 41 and the temperature sensors 42 is visually displayed thereon. The page counter reading and the entire data log stored in the non-volatile memory 43 (EEPROM) is also fetchable via the display 31.

Given the illustrated exemplary embodiment, the sensors identify the aging condition of the developer mix. However, it can also be necessary to control or, respectively to acquire further parameters of the developing process. This, for example, can be the modification of the bias voltage at the developer drums. For this purpose, the central unit 33 of the identification arrangement 30 comprises a reserve terminal 49.

In addition to said data, the specific identification data of the developer station are also stored in the non-volatile memory 43. These are, for example, the serial number and the type of developer station. These data are input into the non-volatile memory 43 upon initial commissioning of the developer station and remain stored in callable fashion therein. They can be visualized with the assistance of the display unit 31 (picture screen) like the other data.

The assistance of the above-described identification arrangement makes it possible to utilize a plurality of developer stations in an electrophotographic printer unit dependent on the degree of usage. It is thus likewise possible given a device park with a plurality of electrophotographic printer means to select the corresponding developer station from a supply of developer stations when color printing is desired an to insert this into the printer having the color printing job that has been called.

The type of developer station, its aging condition and the aging condition of the developer mix are automatically called from the non-volatile memory 43 via the device controller 40 given replacement and are made available to the operator via the user interface 31. It is also possible to call alarm procedures dependent on the content of the data log of the non-volatile memory 43. When, for example, the developer mix has aged to such an extent that the carrier particles must be replaced because of coating (enveloping of the carrier particles, this procedures is displayed at the picture screen 31 and the printing operations are interrupted or, respectively, the startup of printing is prevented.

It can also be imagined to design a mobile inquiry control with which it is possible to interrogate the operating conditions of the introduced developer station by connection to this controller independent of the device controllers of the electrophotographic printer devices.

The invention was described above with reference to an interchangeable developer station. Of course, the inventive principle can also be applied to other interchangeable modules such as the fixing station, delivery unit, turn-over station, etc.

Control Panel Process Controller

Figure 4:
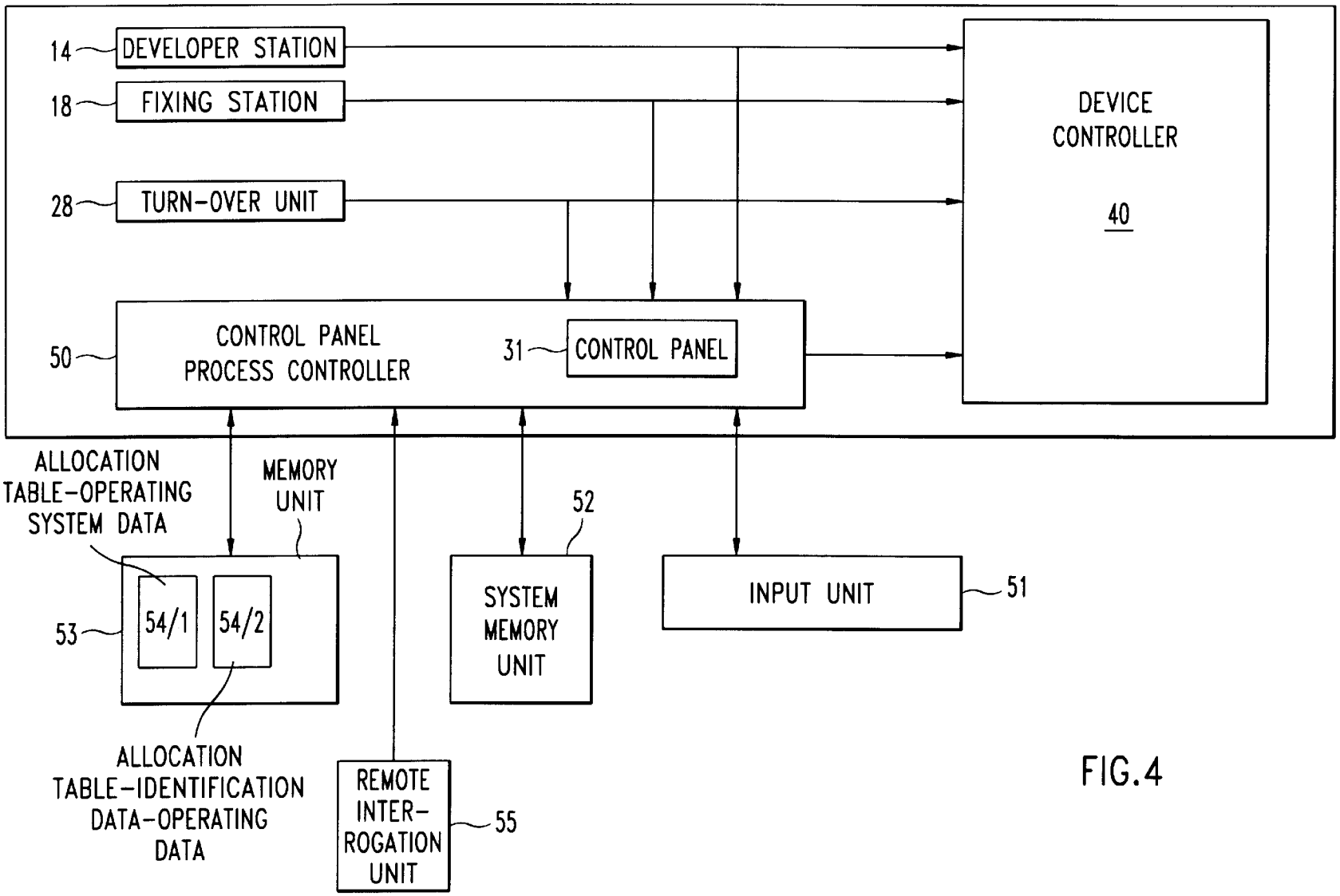
FIG. 4 is a schematic block circuit diagram of a control panel process control arrangement allocated to the control panel.

According to the illustration of FIG. 4, a control panel process controller contains the actual display 31 and a microprocessor or PC control 50. A touch screen control 51 serves as input unit. Instead of the touch screen input, an input via a keyboard is also possible. A memory 52 in the form of a hard disk is connected to the PC control (central unit). It serves as system memory unit for storing the system history. A further non-volatile memory 53 in which two allocation tables 54/1 and 54/2 are stored is also connected to the PC control. The allocation table 54/1 contains the possible operating data of the individual units such as, for example, counter reading and toner type with the allocated system data such as toner concentration given the required toner type or other electrophotography settings given the corresponding counter reading. These operating data are also stored in the identification unit 30. The allocation table 54/1 sees to the corresponding allocation of one data type to one another. The identification numbers, i.e. the type of the individual units 18, 28, as well as the operating data such as counter reading and toner type belonging to the identification numbers are contained in the allocation table 54/2. The process controller 50 is, on the one hand, functionally coupled (data bus) to the individual sub-units 14, 18, 28 and, on the other hand, to the process controller unit 40 (device controller). In a specific embodiment of the invention, the control panel process control unit 50 can be in communication with a remote interrogation means 55 via which it is possible, for example, to interrogate the content of the memories 52 or 53 in order to obtain information about the system history at a remote service location. It is thus possible to initiate the required service measures before the actual maintenance at the device location and, for example, to order the required replacement parts. This remote interrogation unit can be designed as a standard remote interrogation unit known from data communications.

Function of the Control Panel Process Controller

As already described, the memory 53 contains two different allocation tables that are interpreted via the control panel process control unit 50. The operating data such as toner type and counter reading are arranged in a first table row in the first allocation table 54/1. The counter reading is an internal counter reading about the plurality of printed pages. It provides information about the aging condition. The corresponding system data to be called are contained in a second table row. These, for example, can be the required toner concentration given the corresponding toner type or, in general, the process data of the electrophotography process to be set given the operating data. The identification numbers of the various sub-units are stored in a first table row in the second allocation table 54/2, whereby these identification numbers are either automatically stored upon insertion of the sub-units or, on the other hand, they are manually input via the input unit 51. The operating data such as, for example, toner type and counter reading are allocated to these identification numbers. Both allocation table 54/1 as well as allocation table 54/2 are evaluated by the control panel process controller, and the system data or, respectively, operating data identified in this way are supplied to the process control arrangement (device controller) 40.

When the device is run up from the quiescent condition, the device controller (process control 40) interrogates the sub-units 14, 18 or, respectively, their electronic modules 47, 48 for the stored operating conditions and transmits the data to the control panel unit or, respectively, to the control panel process control unit 50. The control panel process control unit 50 compares the supplied operating data to the stored operating data. When the operating data are present or, respectively, when they correspond to the stored operating data, the corresponding system data (the toner concentration given the example of toner) are forwarded to the device controller. In case of malfunction, i.e. given faulty operating data, the control panel process control unit 50 prevents the run-up of the printer, and the control process control unit 50 displays the faulty operating condition on the display 31. The control panel process control arrangement now automatically checks whether operating data, for example toner type, etc., from the past are stored in the allocation table 54/1 and offers these data on the display 31. The operator now decides whether these data should be employed or not. When the data are employed, the corresponding operating data or, respectively, the corresponding system data are transmitted to the device controller 40.

However, it is also possible that the identification unit 30 at the developer station or, respectively, at the sub-units is malfunctioning and the content of the EEPROM provided thereat can no longer be read. In this case, the operator is prompted for manual input of the corresponding sub-unit identification number via the input unit 51. After input of the corresponding identification number, the control panel process control unit 50 checks whether the corresponding identification number is contained in the allocation table 54/2 or not. When it is contained, the allocated operating data such as toner type and counter reading are called and the corresponding system data are supplied to the device controller 40 via the table 54/1.

An overall system outage due to failure of the memory hardware of a sub-unit is prevented by this automatic procedure.

It is also possible that a sub-unit of an older type is attached to a printer of the described type, this not yet comprising an identification unit 30 or (EEPROM). The corresponding basic unit 48 of the sub-unit recognizes this, for example, based on a coding of the sub-unit, for example in that a specific pin of a plug has no contact. In this case, a procedure similar to that just described is implemented by the device controller. The operator is again prompted to manually input the corresponding sub-unit identification number via the input unit 51. After inputting the corresponding identification, the control panel process control unit 50 checks whether the corresponding identification number is contained in the allocation table 54/2 or not. When it is contained, the allocated operating data such as toner type and counter reading are called and the corresponding system data are supplied to the device controller 40 via the table 54/1. When the identification number is not contained in the allocation table 54/2, then the control panel control interrogates the corresponding data such as toner type, counter reading, etc., and requests manual input. Standard values, for example a contrast setting of the developer station corresponding to the toner type, that correspond to the input data can then be taken from the table 54/1 and employed for the printer control.

FIG. 6 again illustrates the above-described data transfer and the evaluation thereof with reference to the example of a developer station as a sub-unit. A controller (basic unit) allocated to the developer station recognizes, in Step S1, on the basis of an encoding located at the developer station whether a developer station with data memory (IS) or a station without data memory (NIS) is present. When a memory module is present, the basic unit—in Step S2—receives the data located on the memory module and forwards them—in Step S3—to the main module of the device controller 40. A first data type is thereby an identification number of the developer station. When this ID number is known, station-specific data can already be stored in the main module or in the PC control panel connected therewith, these being employed for driving the developer station. In Step S4, the main module then forwards the data for this purpose to the PC control panel. In Step S5, another check is carried out thereat to see whether a developer station with data (IS) or one without data (NIS) is present. In the former instance, the received data are subsequently tested for plausibility (Step S6); in Step S7, specific electrophotographic values such as a value KW for the setting of the contrast are then set dependent on the identified toner type. These values are transferred into the main module in Step S8 and are stored there for data protection. In Step S9, these data for setting electrophotographic parameters are transferred into the basic unit.

Parallel to the transmission of the data from the main module to the PC control panel in Step S4, the toner-specific data are also processed within the main module in Step S10. Dependent on the identified toner type, electrophotographic values are delivered—in Step S11—to the basic unit, and the current counter reading of the developer station is also protected within the main module in Step S12.

When it is found in Step S5 that no data store is present (NIS) at the developer station or that specific data such as the counter reading of the developer station or the toner type are not available, then these data are interrogated in Step S12 and—in Step S13—corresponding standard drive values for the electrophotographic process are taken from a specific memory area of the PC control panel. In Step S14, these data are transferred to the main module, are stored thereat for data protection and—in Step S15—are supplied to the basic unit for control of the electrophotographic parameters of the developer station.

System History

As already described, an additional, non-volatile memory (hard disk 52) is coupled with the control panel process control arrangement 50, each occurring error, each automatically eliminated error, each interchanged sub-unit (for example, developer station), each hardware and software modification and each serious apparatus fault and other comparable data being stored in callable fashion thereon chronologically with date and time of day and current counter reading. In case of error, the system can thus be restored at any time in conformity with the stored system condition. An error is automatically eliminated. When, for example, a communication problem arises between the control panel process control unit 50 and the device controller 40, i.e. this communication is interrupted, then the communication is automatically restored by calling the corresponding data from the system memory unit 52. This means that the system is synchronized and the data of the control panel are updated with the data from the system memory unit 52.

Error rates are also stored in the system memory unit 52. When, for example, one error, for example too low a toner concentration, frequently occurs in the developer station with the identification number A when it is utilized, then this error rate is stored. At the next log on of a system maintenance by docking the service technician in the process control unit 50 in service dialog, the process control arrangement reports the frequent occurrence of this error via the display 31. The service technician can thus identify the developer station having identification number A as an unreliable sub-unit and can eliminate the error.

This interrogation of the system history is also possible via the remote interrogation unit 55. For this purpose, the service technician docks into the system history from the service management that is arranged somewhere at a distance from the unit. The described warnings and the information about the error rate with allocated identification number of the sub-unit is automatically communicated to him. He can thus optimally prepare the system maintenance before actually reaching the service location with the apparatus.

For eliminating the error, however, other specific algorithms are also conceivable. Upon log-on of the system maintenance, thus, a check is initially carried out to see whether additional, stored data are present in the system history since the most recent system maintenance. When no new data are present, then no data can of necessity be made available for the error diagnosis. When system data have been stored in the meantime, these are interpreted in the described way.

Wireless Data Transmission

Figure 5:
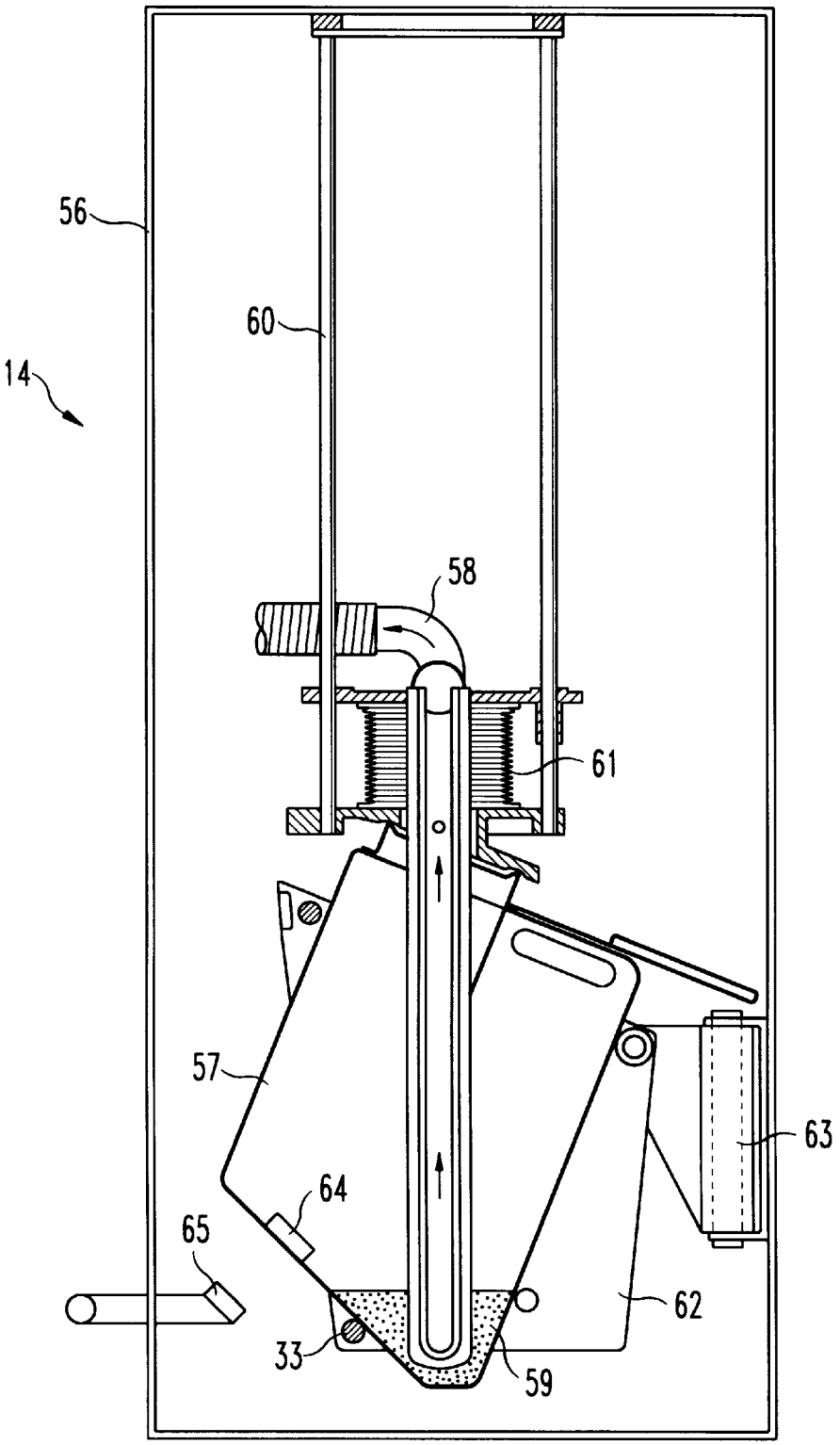
FIG. 5 shows the part of the developer station in which a toner bottler is introduced.

FIG. 5 shows a toner delivery unit 56 of a developer station 14 that contains a toner container 57. The toner 59 situated therein is suctioned from the toner container 57 with a suction nozzle 58 and is supplied to further components of the developer station 14. The suction nozzle 58 is thereby displaced along the guide rods 60 dependent on the toner filling level in the toner container 57. An accordion bellows 61 covers the filling opening of the toner container and thus protects other components of the developer station 14 against contamination. The toner container 57 resides in a receptacle container 62 that can be pivoted into the interior of the printer via a hinge 63. Details regarding this developer station are disclosed in U.S. Pat. No. 5,074,342 whose content is thus incorporated into the specification by reference.

The toner container 57 is provided with a chip card 64 that contains an electronic memory (EEPROM), a drive circuit (IC) as well as an antenna via which a wireless data transfer to a read station 65 can occur. The read station 65 can be optionally secured to the developer station 14 or to the printer housing and is connected to the process control unit 40 via a cable connection (for example, CAN bus). It can carry out both the data exchange with the chip card 64 as well as an energy supply of the chip card 65. Details about such chip cards and read stations are disclosed, for example, in U.S. Pat. No. 5,262,712, whose content is thus likewise incorporated by reference.

In the illustrated exemplary embodiment, the toner type, for example, the color thereof as well as the filling level of the bottle, are stored in the memory (EEPROM) of the toner bottle. The filling level is continuously updated during operation of the printer unit in that the amount of toner removed is identified and subtracted from the initial filling level. As a result thereof, it is possible to take toner bottles partially emptied from the developer station and to re-employ them later in the same or in some other device. In a simplified embodiment, a printed page count can also be stored instead of the exact filling level, the remaining amount of toner being capable of being roughly estimated therefrom.

Although some of the above exemplary embodiments were described with a plugged connection (CAN bus) and others were described with wireless data transmission (IC chip), it is clear that the type of data transmission can be respectively transferred from one to another exemplary embodiment within the scope of the invention. Given a wireless data transmission, the energy can be capacitatively or inductively coupled in from the outside. Further, it can be provided to provide a central communication interface (transmitter and/or receiver) in the printer or copier device that wireless communicates with a plurality of sub-units, so that the data transmission is simplified even farther.

Although various minor changes and modifications might be proposed by those skilled in the art, it will be understood that our wish is to include within the claims of the patent warranted hereon all such changes and modifications as reasonably come within our contribution to the art.

LIST OF REFERENCE CHARACTERS

10 recording medium, paper
11 photoconductor drum
12 charging means
13 character generator
14 developer station
15 transfer printing station
16 cleaning station
17 discharge means
18 fixing station
21 delivery means
22 internal stacking means
23 supply area
24 delivery rollers
25 conveyor means
26 printer module
27 rails
28 turn-over means
29 return channel
30 identification arrangement
31 control panel
32 printed circuit board
33 central unit
34 digital-to-analog converter
35 terminal
36 analog-to-digital converter
37 terminal
38 data interface
39 can bus
40 device controller
41 toner concentration sensor
42 temperature sensor
43 non-volatile memory eeprom
44 plug at the can bus
45 paper transport sub-module
46 traverse
47 fixing station sub-module
48 basic unit sub-module
49 reserve terminal
50 control panel process controller
51 input means, touch screen, keyboard
52 system memory means (hard disk)
53 memory means for allocation tables
54/1 allocation table, operating data-system data
54/2 allocation table, identification data-operating data
55 remote interrogation means
56 toner delivery means
57 toner container
58 suction nozzle
59 toner
60 guide rods
61 accordion bellows
62 receptacle container
63 hinger
64 data store
65 lead station

What is claimed is:

1. A printer or copier device, comprising:

one or more modularly constructed, interchangeable sub-units;

at least one of the sub-units which is to be identified comprising an identification unit having a non-volatile memory for storing operating data of the sub-unit allocated to function-relevant operating conditions; and a communication interface for coupling the identification unit to a process control unit of the device, the communication interface effecting an at least partially wireless data transmission between the sub-unit and the process control unit.

2. The printer or copier device according to claim 1 wherein the communication interface effects both a wireless data exchange with the identification unit as well as a wireless energy supply of the identification unit.

3. The printer or copier device according to claim 1 comprising sensors allocated to the sub-units and acquiring operating conditions that are in communication with at least one of the identification units and the communication interface, and wherein the identification unit comprises an internal interrogation unit that deposits operating data in the non-volatile memory during operation of the sub-unit.

4. The printer or copier device according to claim 1 wherein the process control unit comprises a process interrogation unit which, upon initialization of the sub-units, performs at least one of the functions of reading operating data from the non-volatile memory and during operation of the sub-unit depositing operating data in the non-volatile memory.

5. The printer or copier device according to claim 1 wherein the process control unit is coupled to a display unit displaying selectable operating data.

6. The printer or copier device according to claim 5 wherein the display unit comprises an input unit for input of selectable operating data.

7. The printer or copier device according to claim 1 wherein the non-volatile memory comprises an EEPROM.

8. The printer or copier device according to claim 1 comprising a CAN bus as a communication interface.

9. The printer or copier device according to claim 1 comprising a developer station arranged interchangeably in the device as said at least one sub-unit to be identified.

10. The printer or copier device according to claim 1 wherein the operating data allocated to function-relevant operating conditions are stored as a data log that individually and unambiguously enables an exact tracking of the operating conditions including operating malfunctions for the at least one sub-unit.

11. The printer or copier device according to claim 1 comprising a control panel that, on the one hand, is coupled to the process control unit and, on the other hand, is coupled to identification units of the sub-units, whereby the control panel comprises a control panel process controller that generates system data to be supplied to the process control unit from operating data of the sub-units.

12. The printer or copier device according to claim 11 having a memory unit accepting allocation tables allocated to the control panel process controller.

13. The printer or copier device according to claim 12 wherein the operating data with the corresponding system data are stored in a first allocation table and identification data with the corresponding operating data allocated to the sub-units are stored in a second allocation table.

14. The printer or copier device according to claim 13 comprising a further system memory unit allocated to the control panel process control and containing system history.

15. The printer or copier device according to claim 12 comprising a remote interrogation unit that can be coupled to the control panel process controller for remote interrogation of operating conditions.

16. A method for operation of a printer or copier device that comprises one or more modularly constructed interchangeable sub-units, whereby at least one of the sub-units which is to be identified comprises an identification unit having a non-volatile memory for storing operating data of the at least one sub-unit allocated to function-relevant operating conditions, as well as a communication interface for coupling of the identification unit to a process control unit of the printer or copier device, comprising the steps of:

after installation of the at least one sub-unit into the printer or copier device, carrying out a check with a read station as to whether at least one of an electronic data memory and predetermined data of a first data type are present at the at least one sub-unit;

when no data memory is present, data of the first data type and data of a second data type are taken from a memory of the printer or copier device and supplied to the process control unit;

when the data store is present and data of the first data type are missing, the missing data are asked for via a control panel, are input, and are supplied to the process control unit; and when data of the first data type are present, these are read from the data store by the read station and are supplied to the process control unit.

17. The method according to claim 16 wherein a wireless data transmission occurs between the data store and the read station.

18. The method according to claim 17 wherein energy is supplied in wireless fashion from the read station to the identification unit.

19. A sub-unit provided for installation and for employment in a printer or copier device, and wherein the printer or copier device has a communication interface for coupling of an identification unit to a process control unit of the printer or copier device; comprising:

an identification unit having a non-volatile memory for storing operating data; and the identification unit comprising an electronic memory, and a control and communication circuit for non-contacting data transfer via said communication interface.

20. The sub-unit according to claim 19 wherein the communication interface effects a wireless data transfer and/or a wireless energy supply from the process control unit to the identification unit.

21. The sub-unit according to claim 20 wherein the sub-unit comprises a toner container.

22. The sub-unit according to claim 21 wherein the sub-unit comprises a developer station.

23. The sub-unit according to claim 20 wherein the sub-unit comprises a fixing station.

24. The sub-unit according to claim 20 wherein the electronic memory comprises an EEPROM.

25. A method for operation of a printer or copier device, comprising the steps of:

providing a sub-unit to be identified with an identification unit having a nonvolatile memory for storing operating data of the sub-unit allocated to function-relevant operating conditions, and a communication interface for coupling of the identification unit to a process control unit of the printer or copier device;

after the installation of the sub-unit into the printer or copier device, carrying out a check with a read station as to whether at least one of an electronic data store and predetermined data of a first data type are present in the sub-unit;

when no data store is present, taking the data of the first data type and data of a second data type from a memory of the printer or copier device and supplying it to the process control unit;

when the data store is present and data of the first data type are missing, asking for the missing data via a control panel and inputting it and supplying it to the process control unit; and when data of the first data type are present, reading it from the data store by the read station and supplying it to the process control unit.

26. The method according to claim 25 wherein a wireless data transmission occurs between the data store and the read station.

27. The method according to claim 26 wherein energy is supplied in wireless fashion from the read station to the identification unit.

28. A toner container for employment in a printer or copier device having a process control unit, comprising:

an identification unit having a non-volatile memory for storing operating data as well as a communication interface for transmission of at least one of data and energy between the identification unit and the process control unit; and the communication interface containing a transmission element with which at least one of a wireless data transfer and a wireless energy supply occurs.

29. The toner container according to claim 28 wherein the transmission element is an antenna.

30. The toner container according to claim 28 wherein the energy is wirelessly supplied by at least on e of inductive and capacitive fashion to the identification unit from a read station arranged in the printer or copier device.

31. The toner container according to claim 28 whereby the memory can be read, erased and written.

32. The toner container according to claim 31 wherein a number of printed pages are stored in the memory.

33. A method for operation of a printer or copier device having a toner container, comprising the steps of:

providing an identification unit on the toner container with a non-volatile memory for storing operating data as well as a communication interface for coupling of the identification unit to a process control unit of the printer or copier device;

inserting the toner container into the printer or copier device, and then checking a read station whether an electronic data memory is present on the toner container; and when a data memory is present, stored data are read from the data store by the read station and are supplied to the process control unit.

34. The method according to claim 33 wherein a wireless coupling of the identification unit to the process control unit occurs with a transmission element that enables a transmission of at least one of data and energy between the identification unit and the process control unit.

35. The method according to claim 34 whereby the transmission element is an antenna.

36. The method according to claim 33 whereby energy is wirelessly supplied by at least one of inductive or and capacitative coupling to the identification unit from the read station.

37. The method according to claim 33 whereby data about a type of toner located in the toner container are stored in the data store.

38. The method according to claim 33 whereby a filling level of the toner container is continuously updated during a printing operation.

39. A method for operating a printer or copier device having a toner container, comprising the steps of:

providing a process control unit in the printer or copier device;

providing on the toner container an identification unit having a data memory;

providing a read station for wireless communication with the identification unit of the toner container;

storing in the data memory of the identification unit of the toner container information relating to toner contained in the toner container;

when the toner container is placed in the printer or copier device, interrogating the identification unit with the read station to obtain the information in the data store relating to the toner in the toner container; and using the process control unit, deciding how to operate the copier or printer device based on the toner information received from the data memory of the toner container.

40. The method according to claim 39 wherein the data memory of the identification device in the toner container comprises a non-volatile memory.

41. The method according to claim 39 wherein the read station transmits energy to the identification device in wireless fashion so that the identification device send stored information to the read station when it is interrogated.

42. The method according to claim 39 including the step utilizing the read station to also program the data memory in the identification device of the toner container.

* * * * *